US008967058B2

(12) United States Patent
Brennwald

(10) Patent No.: US 8,967,058 B2
(45) Date of Patent: Mar. 3, 2015

(54) SLAG REMOVER FOR DISCHARGING COMBUSTION RESIDUES OF AN INCINERATION PLANT

(75) Inventor: Werner Brennwald, Neftenbach (CH)

(73) Assignee: Hitachi Zosen Inova AG, Zurich (CH)

( * ) Notice: Subject to any disclaimer, the term of this patent is extended or adjusted under 35 U.S.C. 154(b) by 24 days.

(21) Appl. No.: 13/585,355

(22) Filed: Aug. 14, 2012

(65) Prior Publication Data

US 2013/0047899 A1 Feb. 28, 2013

(30) Foreign Application Priority Data

Aug. 25, 2011 (EP) ..... 11006950

(51) Int. Cl.
*F23J 1/06* (2006.01)
*F23J 1/02* (2006.01)

(52) U.S. Cl.
CPC ..... *F23J 1/02* (2013.01); *F23J 2700/003* (2013.01); *F23J 2900/01021* (2013.01)
USPC ..... 110/165 R; 110/259; 110/266

(58) Field of Classification Search
CPC ..... F23J 1/02; F23J 1/06; F23J 2700/001; F23J 2700/002; F23J 2700/003; F23J 2900/01021; F23J 2900/01005
USPC ..... 110/165 R, 166, 167, 168, 169, 170, 110/171, 259, 266, 341, 342; 126/169, 173, 126/152 B
See application file for complete search history.

(56) References Cited

U.S. PATENT DOCUMENTS 1,941,791 A * 1/1934 De Voe ..... 110/165 R
2,244,793 A * 6/1941 Mosshart ..... 110/290
2,667,848 A * 2/1954 Silk ..... 110/165 R
2,764,277 A 9/1956 Mitchell
2,860,626 A * 11/1958 Hebert ..... 126/169
2,983,234 A * 5/1961 Reilly ..... 110/165 R
3,307,507 A * 3/1967 Boyd et al. ..... 110/240
3,932,280 A * 1/1976 Anderson ..... 110/259
4,048,928 A 9/1977 Martin (Continued)

FOREIGN PATENT DOCUMENTS

DE 25 39 615 A1 3/1977
EP 0 363 645 A1 4/1990
WO WO 2005/078346 A1 8/2005

OTHER PUBLICATIONS

European Search Report issued in Application No. 11 00 6950; Dated Dec. 14, 2011 (With Translation).

*Primary Examiner* — Kenneth Rinehart
*Assistant Examiner* — Tavia Sullens
(74) *Attorney, Agent, or Firm* — Oliff PLC

(57) ABSTRACT

A slag remover for discharging combustion residues of an incineration plant comprises a trough, which has a trough housing having two side walls, which define the trough width, and having a trough bottom, and which is intended to collect the combustion residues evacuated from a combustion chamber of the incineration plant. The trough further comprises at least two push rams for pushing the combustion residues out of the trough, and a shaft rotatably mounted in two shaft bearings and on which at least one drive lever cooperating with a cylinder-piston unit and at least two output levers connected to respectively one of the push rams are disposed in a rotationally secure manner. The cylinder-piston unit is here designed such that the push rams move back and forth between a retracted position and an extended position. The drive lever is disposed between two output levers.

13 Claims, 5 Drawing Sheets

(56) References Cited

U.S. PATENT DOCUMENTS 4,512,265 A * 4/1985 Buchmuller et al. ..... 110/171
4,520,738 A 6/1985 Takehara
4,976,206 A 12/1990 Steiner et al.
5,799,591 A * 9/1998 Anderson ..... 110/165 R
6,648,514 B2 * 11/2003 Cevasco et al. ..... 384/281

* cited by examiner

SLAG REMOVER FOR DISCHARGING COMBUSTION RESIDUES OF AN INCINERATION PLANT

INTRODUCTION

The present invention relates to a slag remover for discharging combustion residues of an incineration plant, and to the use of the slag remover for a waste incineration plant.

BACKGROUND

In the field of waste incineration, slag removers serve to discharge from the incineration plant, in the course of the incineration, the residues (slag) which cannot be further incinerated.

Slag removers generally comprise a drop shaft, via which the combustion residues fall from the combustion chamber into a water-filled trough. From this, the combustion residues are pushed by means of a push ram over an expulsion chute or expulsion path, whence they can be transported onward in dumpable form.

One example of a slag remover is described, for instance, in DE-A-2539615. Here a discharge piston, which pushes into the expulsion chute the slag which falls onto the trough bottom, is articulately connected at its rear end to one or more thrust cranks, which are seated in a rotationally secure manner on a shaft which is rotatably mounted in bearings in the side walls of the trough. Disposed in a rotationally secure manner on both ends of the shaft, which ends project beyond the side walls, are lever arms, which respectively cooperate with a hydraulic piston-cylinder unit.

A drawback with such a slag remover is that, for instance, when slag is present which is conveyable only with great effort and this is distributed inhomogeneously over the trough cross section, load torques, which necessitate appropriate dimensioning of the shaft, are generated. Moreover, the moments of force which act on the respective bearing are in this slag remover relatively large, which is not conducive to optimal force transmission.

Since the lever arms must in most cases be removable, in a slag remover such as that according to DE-A-2539615, in which the force flow goes via the bearings disposed in the side walls, keyways are generally provided. However, as a result of the accompanying weakening of the shaft or lever arm, the mechanical stability thereof is impaired. Moreover, the fitting of keyways or corresponding keys is relatively complex and expensive.

A further slag remover is disclosed, for instance, in EP-A-0363645, according to which two push rods, which are mounted rotatably on a lever by means of a joint, are present. The lever is here configured as a two-armed lever, between whose arms a pivot shaft is disposed. As opposed to DE-A-2539615, according to EP-A-0363645 joints are prevented from dipping into the water fill of the trough. The problems with respect to the generation of load torques in the shaft persist, however.

SUMMARY

An object of embodiments of the present invention thus lies in providing a slag remover that avoids the generation of load torques and enables optimal force transmission to the push ram.

In embodiments, the slag remover comprises a trough, which is intended to collect the combustion residues evacuated from a combustion chamber of the incineration plant, as well as at least two push rams for pushing the combustion residues out of the trough.

Each of the push rams is connected to an output lever. The output levers are disposed in a rotationally secure manner on a shaft rotatably mounted in two shaft bearings.

Also disposed on the shaft is a drive lever, which cooperates with a cylinder-piston unit. The latter is designed such that the push rams move back and forth between a retracted position and an extended position.

In such embodiments, the drive lever is now disposed between two output levers. In contrast to the previously known slag removers, in which the drive levers are disposed on the ends of the shaft which project beyond the side walls, the arrangement of the drive and output levers can serve to ensure that, even given the presence of combustion residues which are conveyable only with great effort, the shaft is not exposed to load torques. Moreover, the arrangement of the drive and output levers enables optimal force transmission from the cylinder-piston unit to the push rams, which, inter alia, is associated with the fact that the force flow, in contrast to said previously known slag removers, does not go via the shaft bearings. As a result of the optimization of the force transmission or the reduction in load torques which is attainable according to embodiments of the invention, the shaft can be dimensioned relatively slim.

Optimal reduction or elimination of load torques is obtained, in particular, when the slag remover comprises just a single drive lever and just a single cylinder-piston unit cooperating therewith. This yields the advantage, in particular for this embodiment, that an adjustment of various cylinder piston units, or a monitoring that these are running in parallel during operation, is fully dispensed with, whereby very simple and efficient operation is enabled.

With a view to optimal force transmission, the drive lever is preferably disposed symmetrically between the output levers.

Preferably, the slag remover has precisely two output levers. Any higher number is also conceivable, however, with preference, in particular, for an even number of drive levers, since a symmetrical arrangement of the drive lever between the output levers is thereby enabled.

In general, the shaft extends at least over the trough width, wherein the shaft bearings are disposed on the side walls. Preferably, the drive lever is here disposed substantially midway between the shaft bearings, whereby the force acting on the shaft bearings is thus equally distributed on both shaft bearings.

Embodiments of the present invention allow the shaft to be mounted in bearing pedestals detachably fitted to the trough housing, which makes access to the shaft or to the lever disposed thereon very much easier. Moreover, embodiments of the present invention allow the at least one drive lever and the output levers to be welded to the shaft, whereby very high mechanical stability is ensured.

A removal of the shaft, or of the levers seated thereon, can be realized very easily by a detachment of the bearing pedestals; a splitting of the shaft, or complex keyways, as are necessary in conventional slag removers—such as that according to DE-A-2539.615—can thus be dispensed with in embodiments of the present invention.

As mentioned, the slag remover generally has a drop shaft, through which the combustion residues fall into the trough. In its retracted position, the push ram is generally disposed in a region lying (viewed in the expulsion direction) behind the drop shaft. Preferably, the end face of the push ram here lies in at least approximately the same vertical plane as the rear wall of the drop shaft, which wall faces away from the expulsion direction.

Generally the cylinder-piston unit and the drive lever are also disposed in a region lying (viewed in the expulsion direction) behind the drop shaft.

A particularly preferred drive geometry is obtained when, during operation, the cylinder-piston unit, or the force vector emanating therefrom, is oriented at an angle of less than 20°, preferably less than 10°, particularly preferably less than 5° with respect to the horizontal, since optimal force transmission efficiency from the cylinder-piston unit to the push ram can thereby be obtained. The horizontal here corresponds to the longitudinal axis of the trough running at right angles to the orientation of the drop shaft.

In order to ensure that the cylinder-piston unit, even if oriented substantially horizontally, is present in a space separated from the trough interior, the trough, according to a particularly preferred embodiment, is present, at least in some areas, in the form of two longitudinally running, mutually separate trough channels, wherein the cylinder-piston unit and/or the drive lever are/is disposed, at least in some areas, in the interspace between the trough channels. Since the cylinder-piston unit and the drive lever, viewed in the expulsion direction, are generally disposed in a region lying behind the drop shaft, the trough, according to a preferred embodiment, is present only in this region in the form of trough channels. In the expulsion direction, the trough channels generally open out into a trough basin, by which the trough channels are fluidically connected to one another.

From said water-filled trough basin, which is disposed beneath the mouth of the drop shaft and in which the combustion residues are collected, the interspace, or the cylinder-piston unit or drive lever disposed, at least in some areas, therein, is preferably separated off by means of a partition plate. All in all, the interspace is sectioned off from the trough interior by those channel walls of the trough channels which face the vertical longitudinal axis and by the partition plate.

Through the arrangement of the cylinder-piston unit in the interspace, a very simple removal from below is enabled.

According to a further embodiment of the invention, on a first of the side walls is disposed a first water tank comprising a freshwater connection and a fill level apparatus, and on the second of the side walls is disposed a second water tank comprising a dirty water connection and an overflow. As opposed to the background art, in which the drive levers are disposed on the ends of the shaft which project beyond the side walls, according to embodiments of the invention water tanks can thus be fitted on the side wall without the drive arrangement having to be taken into account in the arrangement and dimensioning of said water tanks. Rather, the above-described arrangement can result in the cylinder-piston unit, and, in particular, the (hydraulic) cylinder thereof, being disposed outside the water tank, which corresponds to a further preferred embodiment of the invention.

The water tanks have a lid, which is preferably dimensioned such that simple cleaning of the interior by means of a water hose is possible. Generally, both water tanks have a slit, disposed in their lower region, for the water flow. Filling takes place into one of the two water tanks and is regulated via the fill level apparatus.

As mentioned in the introduction, the slag remover is suitable, in particular, for a waste incineration plant, since, specifically in waste incineration, very inhomogeneous combustion residues can arise, which, in conventional drive arrangements, can lead to the aforementioned load torques. The invention thus further relates to the use of the slag remover for a waste incineration plant.

Typical trough widths of a slag remover for a waste incineration plant range from about 2 m to 2.5 m. Larger trough widths, preferably up to about 3.2 m, are also conceivable, however. The mouth of the drop shaft into the trough has typically in the longitudinal direction of the trough an extent of about 1 m to 1.5 m. According to the purpose and objective, the dimensions can be readily adapted by the person skilled in the art who has acquired knowledge of the invention.

BRIEF DESCRIPTION OF THE DRAWINGS

Embodiments of the invention are illustrated in detail with reference to the appended figures, wherein.

DETAILED DESCRIPTION OF THE EMBODIMENTS

Figure 1:
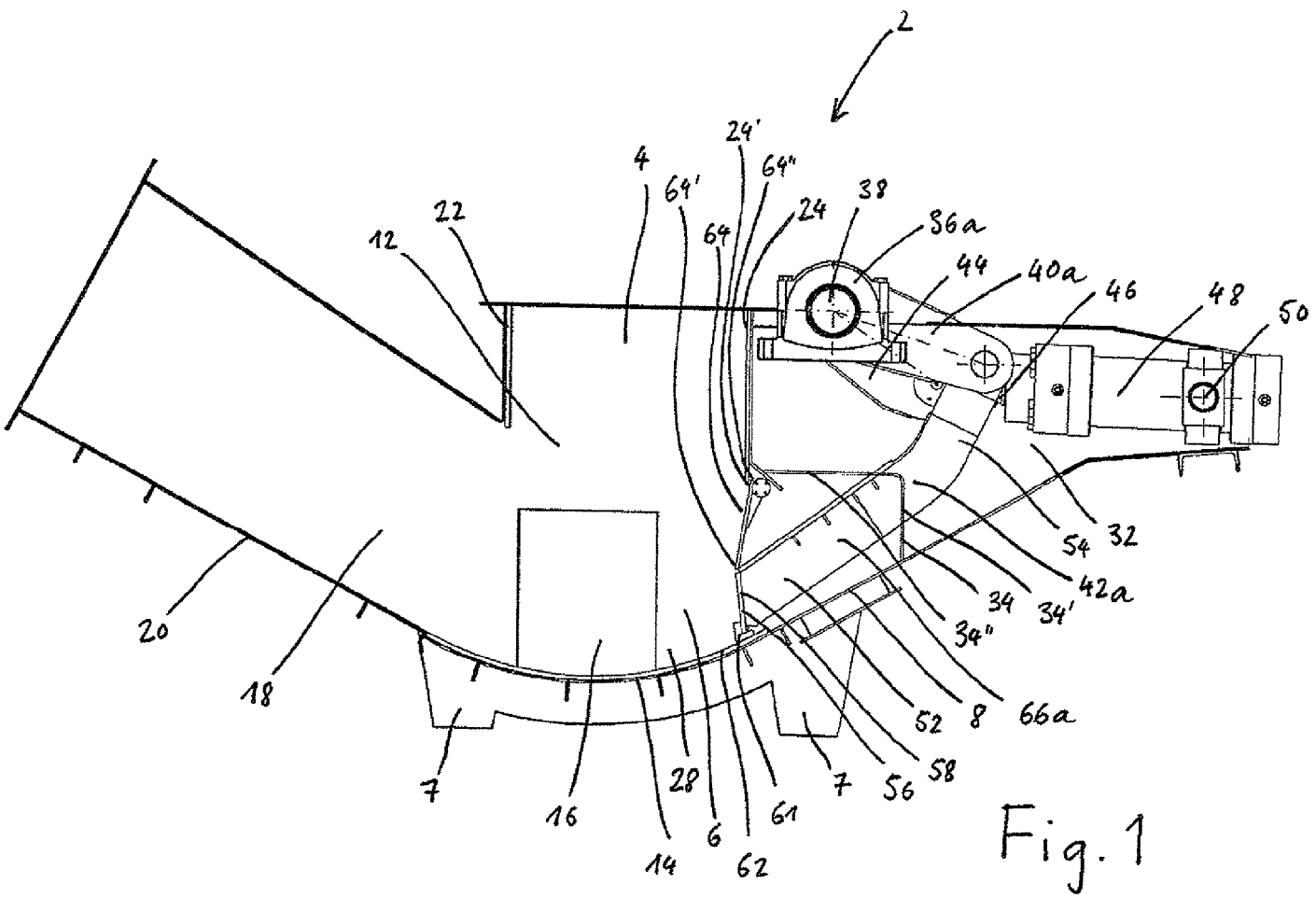
FIG. 1 shows a longitudinal section through a slag remover according to an embodiment of the invention with the push rams in the retracted position.

The slag remover 2 shown in FIG. 1 is generally disposed in the region of the outlet of a combustion chamber (not represented) of an incineration plant. From the combustion grate of the combustion chamber, the non-combustible combustion residues (slag) fall into a vertically running drop shaft 4, which can flare out in the shape of a funnel in the direction of the outlet of the combustion chamber.

The drop shaft 4 opens out into a water-filled trough 6, which is disposed on a supporting structure having appropriate pillars 7 and extends in a longitudinal direction running at right angles to the orientation of the drop shaft 4. In this trough 6 are collected the combustion residues falling through the drop shaft 4. The trough 6 has a trough housing 8 comprising two side walls 10*a*, 10*b*, which define the trough width and respectively run parallel to the longitudinal direction in a vertical plane, and a trough bottom 14, which is arched below the drop shaft mouth 12. In the side walls 10*a*, 10*h* of the trough 6 is respectively provided a sealable opening 16, which allows access to the trough interior for cleaning purposes.

In the expulsion direction, i.e. in the direction of the output of the slag remover, the trough 6 is adjoined by an expulsion chute 18 having an ascending expulsion path 20.

The drop shaft 4 has a (viewed in the expulsion direction) front wall 22 and rear wall 24. As can be seen, in particular, from FIG. 4, in a region lying (viewed in the expulsion direction) behind the drop shaft 4, the trough 6 is present in the form of two separate trough channels 26*a*, 26*b*, which, running obliquely downward, open out into a trough basin 28 disposed directly beneath the drop shaft 4.

The trough channels 26*a*, 26*b* are delimited, on the one hand, (on the side respectively facing away from the longitudinal center plane) by the respective side wall 10*a* and 10*b* of the trough 6 and, on the other hand, by a respective channel wall 30*a* and 30*h* facing the longitudinal center plane and running parallel thereto. Between the trough channels 26*a*, 26*b* or between the channel walls 30*a*, 30*b* is configured an interspace 32. The interspace 32 is separated off from the trough basin 28 by a partition plate 34. In the shown embodiment, this has a vertical region 34' and an adjoining horizontal region 34", as can be seen, in particular, from FIGS. 1 and 2.

In the region behind the drop shaft 4, a shaft bearing 36*a* or 36*b* in the form of a bearing pedestal is respectively detachably fastened to the respective side wall 10*a*, 10*b* by means of appropriate fastening means. In these shaft bearings 36*a*, 36*b* is rotatably mounted a shaft 38, which extends over the trough width.

Seated in a rotationally secure manner on the shaft 38 are two output levers 40*a*, 40*b*, which are respectively articulately connected to a push ram 42*a* or 42*b*. Midway between the output levers 40*a*, 40*b*, a drive lever 44 is disposed in a rotationally secure manner on the shaft 38, which drive lever is connected by its end facing away from the shaft to the piston 46 of a cylinder-piston unit 48. Generally, both the drive lever 44 and the output lever 40*a*, 40*b* are welded to the shaft 38.

Figure 3:
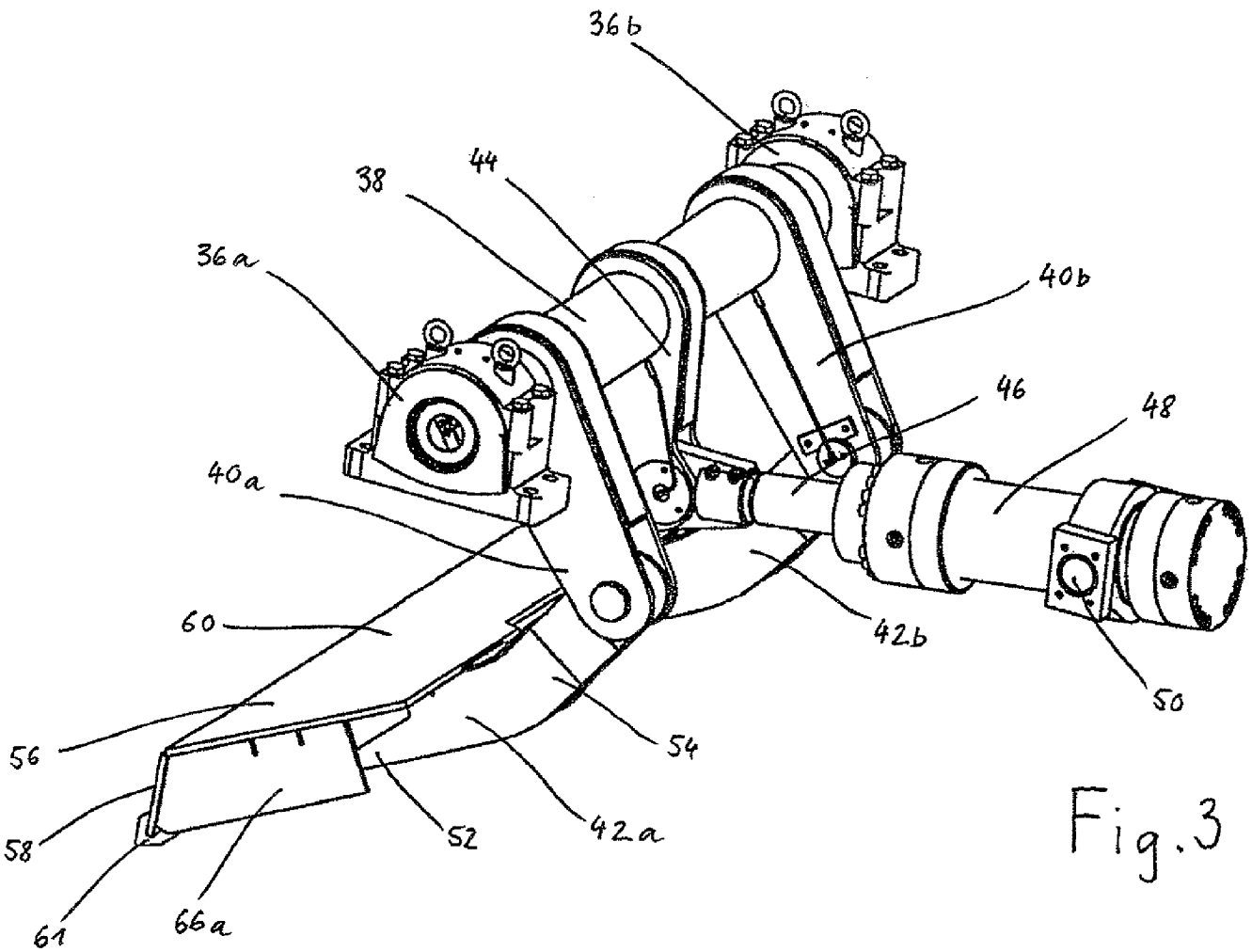
FIG. 3 shows a perspective view of a part, comprising the drive arrangement, of the slag remover according to an embodiment of the invention.

As is evident, in particular, from FIG. 3, the drive lever 44 is disposed on the shaft 38 midway between the output levers 40*a*, 40*b* and runs, together with the cylinder-piston unit 48, in the vertical longitudinal center plane of the trough 6.

Figure 4:
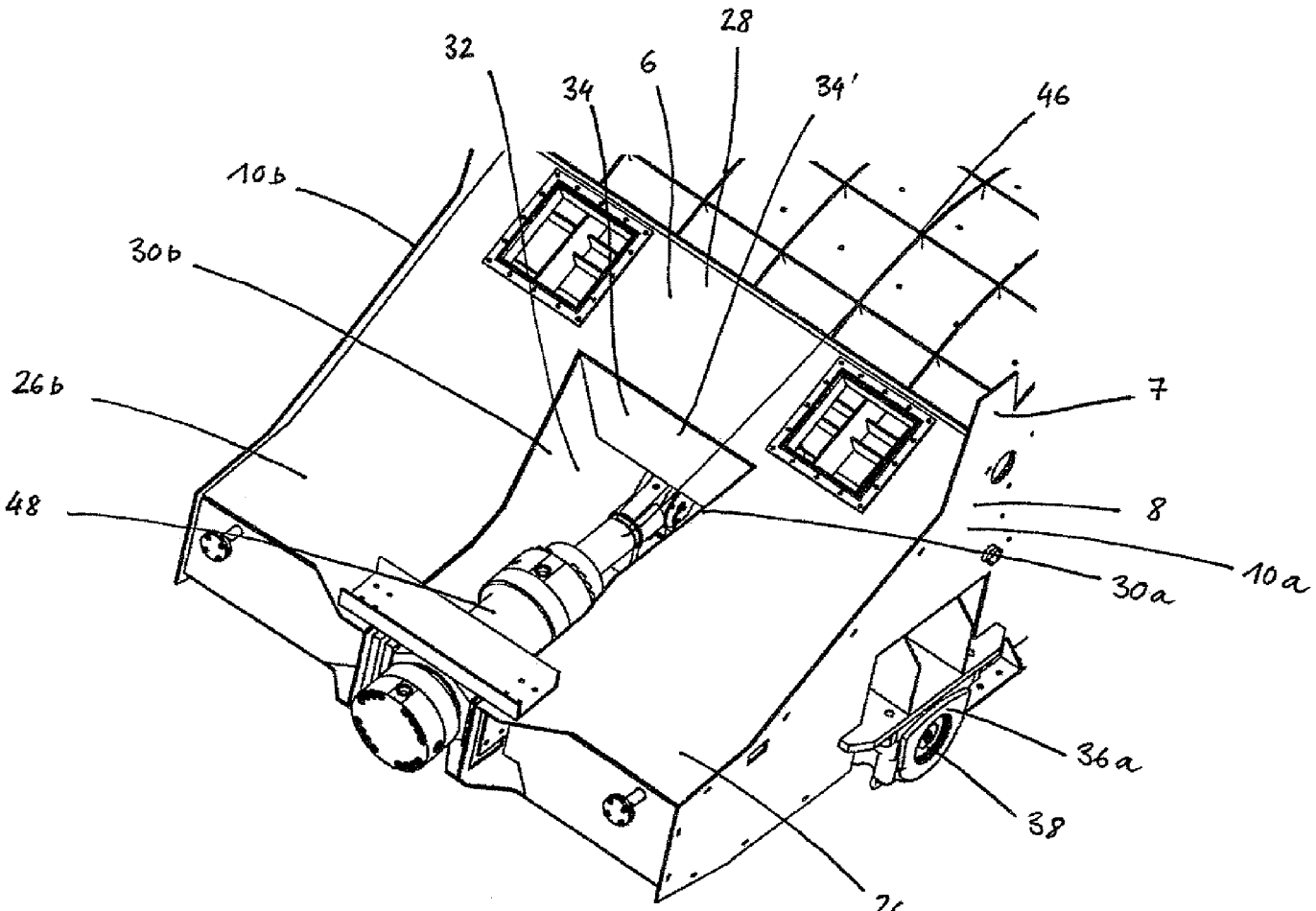
FIG. 4 shows a detail of the slag remover according to an embodiment of the invention from a perspective view from obliquely below.

The cylinder-piston unit 48 is disposed in the interspace 32 between the trough channels 26*a*, 26*h* and is mounted in the channel walls 30*a*, 30*b* via an axle 50, as can be seen, for instance, from FIG. 4. When the piston 46 is retracted, the cylinder-piston unit 48 is arranged substantially horizontally, i.e. parallel to the longitudinal axis of the trough 6.

As is explained in detail further below, during operation of the slag remover a torque is applied to the shaft 38 through the extension of the piston 46 of the cylinder-piston unit 48, which is easily pivotable out of the horizontal, by means of the drive lever 44, whereby the push rams 42*a*, 42*b* are moved by means of the output levers 40*a*, 40*b* from a retracted position according to FIG. 1 into an extended position according to FIG. 2.

The push rams 42*a*, 42*b* have a bend and are divided by this into a front arm segment 52 and a rear arm segment 54. Attached to the free end of the push rams 42*a*, 42*b* is, in the shown embodiment, a push shield 56, which has an end face 58 and a cover 60, which latter runs in a plane obliquely to the plane of the end face and rests on the front arm segment 52.

In the shown embodiment, moreover, on the lower edge of the end face 58 of the push shield 56 is disposed a sliding shoe 61, which rests on a slideway 62 formed by the trough bottom 14.

In addition, the trough 6 has a flap 64, whose free end 64' rests on the cover 60 and whose edge 64" lying opposite the free end is situated above the bottom edge 24' of the rear wall 24 of the drop shaft 4. In the retracted position of the push rams 42*a*, 42*b*, the end face 58, the flap 64 and the rear wall 24 of the drop shaft 4 lie substantially in the same vertical plane.

As can be seen, in particular, from FIG. 3, the push shield 56 has on each side, moreover, a further cover plate 66*a*, 66*b* assigned to the respective side wall 10*a* and 10*b* of the trough 6.

Figure 2:
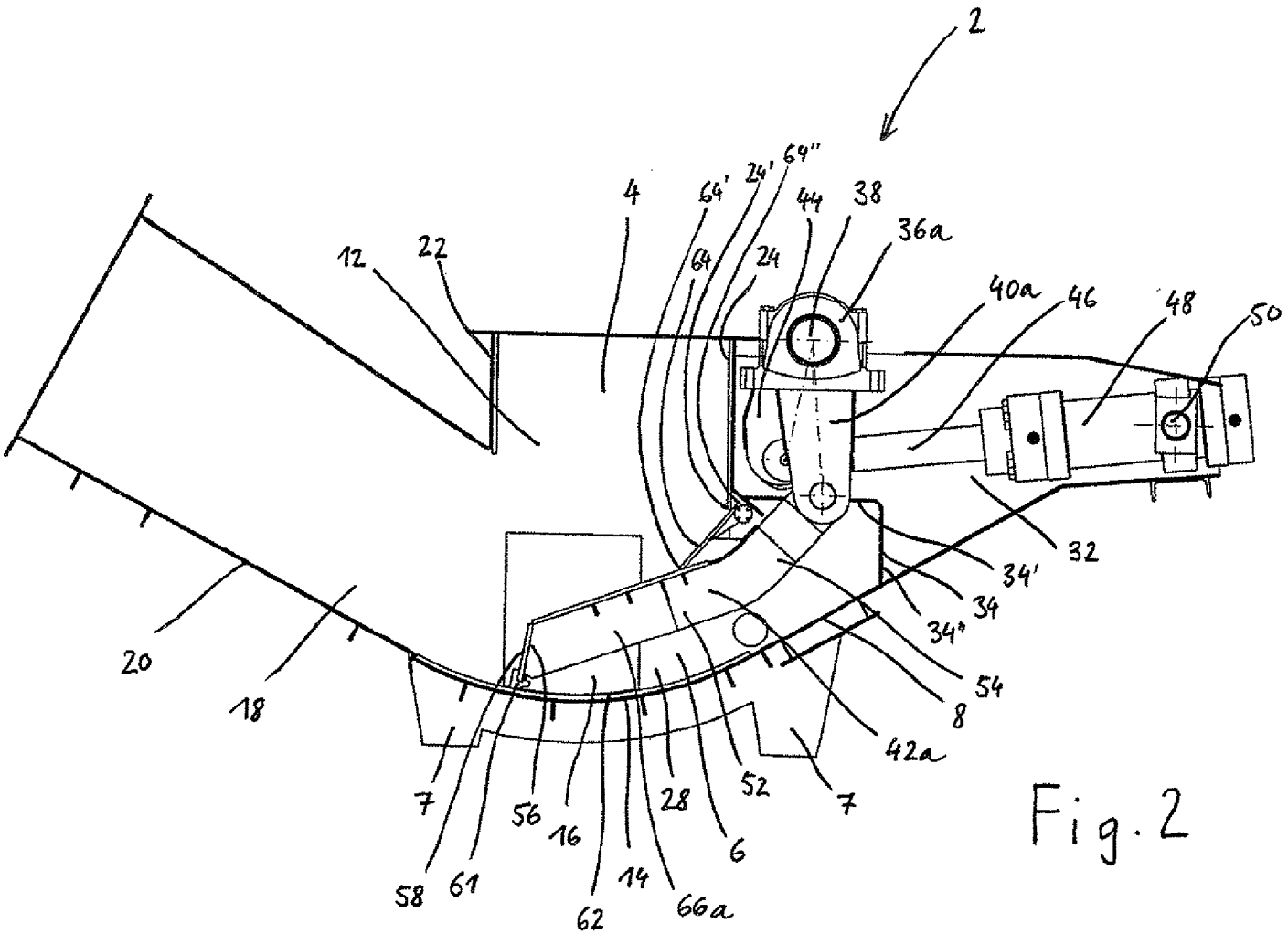
FIG. 2 shows a longitudinal section through the slag remover according to FIG. 1 with the push rams in the extended position.

The movement of the push rams 42*a*, 42*b* by means of the drive arrangement can be seen, in particular, from FIGS. 1 and 2. Here, a torque is applied to the shaft 38 through the extension of the piston 46 of the cylinder-piston unit 48 by means of the drive lever 44, whereby the push rams 42*a*, 42*b* are moved by means of the output levers 40*a*, 40*b* from a retracted position into an extended position. The combustion residues collected in the trough 6 are hereupon pushed out of the trough into the expulsion chute 18 or onto the expulsion path 20.

During the forward movement, i.e. the movement of the push rams 42*a*, 42*b* and thus of the push shield 56 in the direction of expulsion, the flap 64 pivots upward, whereupon it rests with its free end 64' unbrokenly on the cover 60. Combustion residues present in the drop shaft 4 hereupon deposit themselves on the cover 60 or on the flap 64.

Penetration of combustion residues into the space lying (viewed in the direction of expulsion) behind the end face 58 is here effectively prevented by the cover 60 or the additional cover plates 66*a*, 66*b*. Similarly, the flap 64 serves to prevent combustion residues from possibly getting into the space lying behind the flap and thus into the trough channels 26*a*, 26*b*.

During the rearward movement of the push rams 42*a*, 42*b* from the extended into the retracted position, the trough bottom 14, in the region of the trough basin 28, is opened up again for combustion residues falling in from above. The flap 64 hereupon pushes the combustion residues deposited on the cover 60 over the front edge of the cover, so that said combustion residues are deposited in front of the end face 58 on the trough bottom 14. As a result of the combustion residues, which in the retracted position of the push rams 42*a*, 42*b* are present in front of the end face 58, or the resulting blockage effect, the combustion residues present in the expulsion chute 18 are prevented from sliding rearward.

The combustion residues pushed out of the expulsion chute 18 by a renewed stroke of the push rams 42*a*, 42*b* are finally transported away for further use or for dumping.

As can be seen, in particular, from FIG. 4, only that end region 6' of the trough 6 which is facing away from the direction of expulsion is present in the form of trough channels 26*a*, 26*b*, which, in the shown embodiment, have a substantially rectangular cross section. The interspace 32 which is configured between the trough channels 26*a*, 26*b* and encompasses the cylinder-piston unit 48 is separated off from the water-filled trough, on the one hand, by the channel walls 30*a*, 30*h* facing the longitudinal center plane and, on the other hand, by a partition plate 34. The vertical region 34' of the partition plate 34 here runs in a vertical plane, which, viewed in the direction of expulsion, runs behind the vertical plane of the rear wall 24 of the drop shaft 4.

Figure 5:
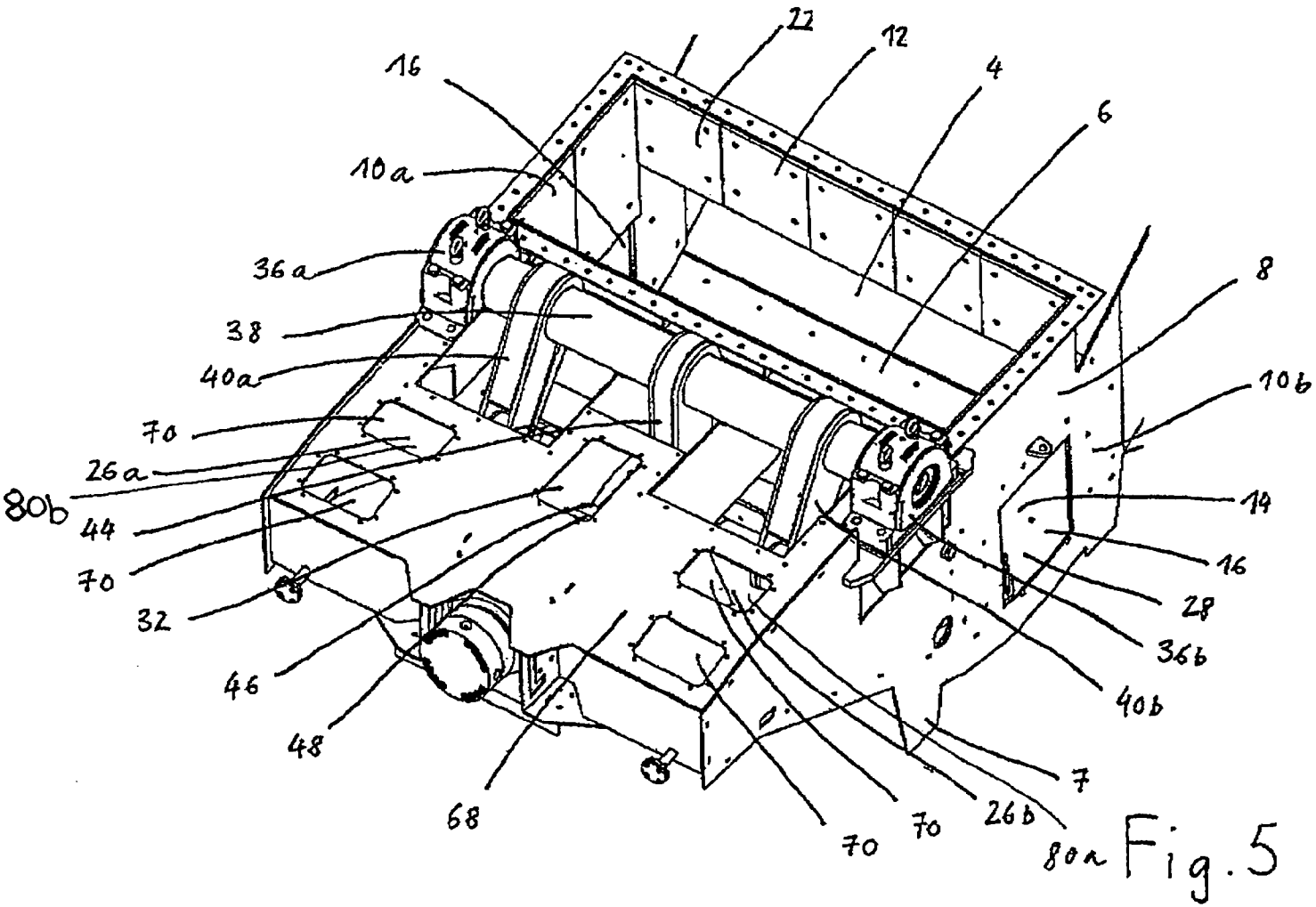
FIG. 5 shows a detail of the slag remover according to an embodiment of the invention from a perspective view from obliquely above.

That region of the trough 6 which lies behind the drop shaft 4, and also the interspace 32, are covered by means of a covering hood 68, as is shown, in particular, in FIG. 5. This is equipped with openings 70, which allow access both to the trough channels 26*a*, 26*b* and to the interspace 32 also from above.

It is further conceivable to dispose (not shown) on a first of the side walls 10*a* or 10*b* a first water tank 80*a* comprising a freshwater connection and a fill level apparatus, and on the second of the side walls 10*b* or 10*a* a second water tank 80*b* comprising a dirty water connection and an overflow.

The shown arrangement of the drive lever 44 in relation to the output levers 40*a*, 40*b* allows optimal force transmission to the push rams. Load torques, such as can be generated, in particular, when two cylinder piston units are present, are effectively avoided. The use of bearing pedestals also allows relatively simple fitting and removal of the shaft 38. The prospect of welding the output levers 40*a*, 40*b* and the drive levers 44 to the shaft 38 enables expensive keyways to be dispensed with.

What is claimed is:

1. A slag remover for discharging combustion residues of an incineration plant, comprising:

a trough having a trough housing comprising two side walls, which define a trough width, and a trough bottom, the trough being configured: (i) to collect the combustion residues evacuated from a combustion chamber of the incineration plant, and (ii) in the form of two mutually separate trough channels at least in some areas, at least two push rams for pushing the combustion residues out of the trough, and a shaft rotatably mounted in two shaft bearings and on which at least one drive lever cooperating with a cylinder-piston unit and at least two output levers connected to respectively one of the push rams are disposed in a rotationally secure manner, the cylinder-piston unit being designed such that the push rams move back and forth between a retracted position and an extended position, wherein:

the at least one drive lever is disposed between the two output levers, and at least one of the cylinder-piston unit and the drive lever are disposed, at least in some areas, in an interspace between the trough channels.

2. The slag remover as claimed in claim 1, wherein the slag remover comprises a single drive lever and a single cylinder-piston unit.

3. The slag remover as claimed in claim 1, wherein the drive lever is disposed symmetrically between the output levers.

4. The slag remover as claimed in claim 1, wherein the shaft extends at least over the trough width and the shaft bearings are disposed on the side walls.

5. The slag remover as claimed in claim 1, wherein the drive lever is disposed substantially midway between the shaft bearings.

6. The slag remover as claimed in claim 1, wherein, during operation, the cylinder-piston unit is oriented at an angle of less than 20° with respect to the horizontal.

7. The slag remover as claimed in claim 1, wherein the trough channels open out into a trough basin and are fluidically connected to one another by this.

8. The slag remover as claimed in claim 1, wherein the shaft bearings are configured as a bearing pedestal detachably fitted to the trough housing.

9. The slag remover as claimed in claim 1, wherein the drive lever is welded to the shaft.

10. The slag remover as claimed in claim 1, wherein the output levers are welded to the shaft.

11. The slag remover as claimed in claim 1, wherein the cylinder of the cylinder-piston unit is disposed outside the trough channels.

12. A waste incineration plant, comprising:

a combustion chamber; and a slag remover for discharging combustion residues of an incineration plant, the slag remover including:

a trough having a trough housing comprising two side walls, which define a trough width, and a trough bottom, the trough being configured: (i) to collect the combustion residues evacuated from a combustion chamber of the incineration plant, and (ii) in the form of two mutually separate trough channels at least in some areas, at least two push rams for pushing the combustion residues out of the trough, and a shaft rotatably mounted in two shaft bearings and on which at least one drive lever cooperating with a cylinder-piston unit and at least two output levers connected to respectively one of the push rams are disposed in a rotationally secure manner, the cylinder-piston unit being designed such that the push rams move back and forth between a retracted position and an extended position, wherein:

the at least one drive lever is disposed between the two output levers, and at least one of the cylinder-piston unit and the drive lever are disposed, at least in some areas, in an interspace between the trough channels.

13. A slag remover for discharging combustion residues of an incineration plant having a combustion chamber, comprising:

a trough having a trough housing including: (1) two side walls defining a trough width, and (2) a trough bottom, the trough being configured in the form of two mutually separate trough channels at least in some areas and to collect the combustion residues evacuated from the combustion chamber of the incineration plant;

at least two push rams configured to push the combustion residues out of the trough;

a shaft rotatably mounted on two shaft bearings;

a cylinder-piston unit configured to move the push rams back and forth between a retracted position and an extended position;

at least one drive lever where one end of the drive lever is configured to connect to the cylinder-piston unit and the other end of the drive lever is configured to connect to the shaft; and at least two output levers where one end of the output lever is configured to connect to one of the push rams and the other end of the output lever is configured to connect to the shaft, respectively, wherein:

the at least one drive lever is disposed between the two output levers, and at least one of the cylinder-piston unit and the drive lever are disposed, at least in some areas, in an interspace between the trough channels.

* * * * *